US010258840B2

(12) United States Patent
Larson

(10) Patent No.: US 10,258,840 B2
(45) Date of Patent: Apr. 16, 2019

(54) GOLF CLUBS AND GOLF CLUB HEADS HAVING ADJUSTABLE WEIGHTING CHARACTERISTICS

(71) Applicant: NIKE, Inc., Beaverton, OR (US)

(72) Inventor: Eric A. Larson, Ft. Worth, TX (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 220 days.

(21) Appl. No.: 14/745,089

(22) Filed: Jun. 19, 2015

(65) Prior Publication Data

US 2016/0067570 A1 Mar. 10, 2016

Related U.S. Application Data

(63) Continuation of application No. 11/765,774, filed on Jun. 20, 2007, now Pat. No. 9,061,186.

(51) Int. Cl.
*A63B 53/00* (2015.01)
*A63B 53/04* (2015.01)

(52) U.S. Cl.
CPC ..... *A63B 53/047* (2013.01); *A63B 53/04* (2013.01); *A63B 2053/0491* (2013.01)

(58) Field of Classification Search
CPC ..... A63B 2053/0491
USPC ..... 473/334
See application file for complete search history.

(56) References Cited

U.S. PATENT DOCUMENTS 1,133,129 A 3/1915 Govan
1,320,163 A * 10/1919 Maurice ..... A63B 53/047 473/335
2,155,830 A * 4/1939 Howard ..... A63B 53/06 473/246
3,220,733 A * 11/1965 Saleeby ..... A63B 53/0487 473/335
3,419,275 A * 12/1968 Winkleman ..... A63B 53/0487 473/335
4,869,507 A 9/1989 Sahm
(Continued)

FOREIGN PATENT DOCUMENTS

JP S51-140374 11/1976
JP 07-031697 U 2/1995
(Continued)

OTHER PUBLICATIONS

Nov. 5, 2008—(WO) ISR Written Opinion—PCT/US2008/067428.
Jan. 7, 2010—(WO) IPER and Written Opinion—PCT/US2008-067428.

*Primary Examiner* — Gene Kim
*Assistant Examiner* — Matthew B Stanczak

(57) ABSTRACT

Golf club heads include an iron type golf club head body having a rear surface (e.g., a perimeter weighting member) that defines a first weight receiving portion, and a weight member is mounted in the first weight receiving portion. The club head body further defines a second weight receiving portion independent of the first weight receiving portion, and a second weight member is removably engaged with the golf club head body at this second weight receiving portion. The weight members may be interchangeably mounted in the two weight receiving portions to thereby allow selective placement of the center of gravity characteristics of the club head body. Golf clubs including these club heads and methods of making such golf club and golf club heads also are described.

18 Claims, 7 Drawing Sheets

(56) References Cited

U.S. PATENT DOCUMENTS 4,883,274 A 11/1989 Hsien
5,230,509 A * 7/1993 Chavez ..... A63B 53/0487 473/334
5,547,427 A 8/1996 Rigal et al.
5,564,705 A 10/1996 Kobayashi et al.
5,570,886 A 11/1996 Rigal et al.
5,584,770 A 12/1996 Jensen
5,616,088 A 4/1997 Aizawa et al.
5,766,092 A 6/1998 Mimeur et al.
5,769,737 A * 6/1998 Holladay ..... A63B 53/065 473/336
5,833,551 A 11/1998 Vincent et al.
5,916,042 A 6/1999 Reimers
5,938,540 A * 8/1999 Lu ..... A63B 53/04 473/288
5,976,033 A 11/1999 Takeda
6,015,354 A * 1/2000 Ahn ..... A63B 53/04 473/256
6,033,326 A * 3/2000 Lee ..... A63B 59/70 473/560
6,077,171 A 6/2000 Yoneyama
6,077,173 A 6/2000 Stites
6,083,118 A 7/2000 Martins et al.
6,206,790 B1 3/2001 Kubica et al.
6,280,348 B1 8/2001 Stites
6,409,612 B1 6/2002 Evans et al.
6,458,044 B1 10/2002 Vincent et al.
6,530,848 B2 3/2003 Gillig
6,551,200 B1 4/2003 Golden et al.
6,554,719 B2 4/2003 Peters et al.
6,569,029 B1 * 5/2003 Hamburger ..... A63B 53/047 473/238
6,592,468 B2 7/2003 Vincent et al.
6,616,547 B2 9/2003 Vincent et al.
6,648,772 B2 11/2003 Vincent et al.
6,773,361 B1 8/2004 Lee
6,811,496 B2 11/2004 Wahl et al.
6,921,344 B2 7/2005 Gilbert et al.
7,004,852 B2 2/2006 Billings
7,048,647 B2 5/2006 Burrows
7,077,763 B2 7/2006 Wahl et al.
7,083,525 B2 8/2006 Pond et al.
7,083,530 B2 8/2006 Wahl et al.
7,109,611 B2 9/2006 Chuang et al.
7,115,047 B2 10/2006 Stevens et al.
7,121,955 B2 10/2006 Stevens et al.
7,140,974 B2 11/2006 Chao et al.
7,140,976 B2 11/2006 Chen et al.
8,696,491 B1 * 4/2014 Myers ..... A63B 53/06 473/334
9,289,660 B1 * 3/2016 Myers ..... A63B 53/06
9,364,728 B1 * 6/2016 Myers ..... A63B 53/06
9,597,561 B1 * 3/2017 Seluga ..... A63B 53/0466
9,623,294 B1 * 4/2017 Kingston ..... A63B 53/0466
2001/0014628 A1 8/2001 Erickson et al.
2002/0098910 A1 7/2002 Gilbert
2002/0115503 A1 8/2002 Erickson et al.
2002/0165041 A1 11/2002 Takeda
2003/0092499 A1 5/2003 Gilbert
2003/0232659 A1 12/2003 Mahaffey et al.
2004/0171433 A1 9/2004 Ashton
2004/0176177 A1 9/2004 Mahaffey et al.
2004/0214658 A1 10/2004 Meyer
2005/0137024 A1 6/2005 Stites et al.
2005/0221911 A1 10/2005 Beach et al.
2005/0277485 A1 12/2005 Hou et al.
2006/0089206 A1 4/2006 Lo
2006/0122004 A1 6/2006 Chen et al.
2006/0172822 A1 8/2006 Liang et al.
2006/0199661 A1 9/2006 Deng et al.

FOREIGN PATENT DOCUMENTS

JP 08-257181 10/1996
JP 3038925 B2 5/2000
JP 2001062013 A 3/2001
JP 3098096 U 2/2004
JP 2006-212407 A 8/2006
JP 2006239154 A 9/2006

* cited by examiner

GOLF CLUBS AND GOLF CLUB HEADS HAVING ADJUSTABLE WEIGHTING CHARACTERISTICS

CROSS-REFERENCE TO RELATED APPLICATION

This application is a continuation of co-pending U.S. patent application Ser. No. 11/765,774, filed Jun. 20, 2007, which prior application is incorporated by reference herein in its entirety and made part hereof.

FIELD OF THE INVENTION

The present invention relates to golf clubs and golf club heads. Particular example aspects of this invention relate to golf clubs and golf club heads having movable weight members and adjustable weighting characteristics.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available on the market that promise to help lower one's golf scores.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rates, etc.).

While the industry has witnessed dramatic changes and improvements to golf equipment in recent years, some players continue to experience difficulties in reliably hitting a golf ball in an intended and desired direction and/or with an intended and desired flight path. Further, some players continue to experience difficulties in adapting their swing based on particular weather or course conditions (e.g., to reliably and consistently produce higher or lower ball flights, etc.). Accordingly, there is room in the art for further advances in golf club technology.

SUMMARY OF THE INVENTION

The following presents a general summary of aspects of the invention in order to provide a basic understanding of the invention and various aspects of it. This summary is not intended to limit the scope of the invention in any way, but it simply provides a general overview and context for the more detailed description that follows.

Golf club heads according to at least some example aspects of this invention include: an iron-type golf club head body having a ball striking face and a rear surface opposite the ball striking face (e.g., including a perimeter weighting member extending rearward from the ball striking face and along at least a portion of a circumferential area of the golf club head body). The rear surface (e.g., the perimeter weighting member) of this example structure defines at least a first weight receiving portion, e.g., located along a top perimeter portion of the rear surface. A weight member may be removably engaged with the weight receiving portion.

Golf club heads in accordance with at least some examples of this invention further may include club head bodies that define a second weight receiving portion independent of the first weight receiving portion described above (e.g., in the perimeter weighting member, in or along a sole portion of the club head body, etc.). In such golf club head structures, the first weight member may be removably engaged with the golf club head body at one of the first or second weight receiving portions (and it may be structured so as to be engagable with the golf club head body at each of the first and second weight receiving portions), and a second weight member may be removably engaged with the golf club head body at one of the first or second weight receiving portions (and this second weight member also may be structured so as to be engagable with the golf club head body at each of the first and second weight receiving portions). In this manner, the first and second weight members may be interchangeable with one another and may be selectively engaged with the club head body member at the various different weight receiving portions. The first and second weight members preferably will have different weighting characteristics from one another (e.g., different masses, different densities, different weight distributions, etc.) to enable selective modification of the overall club head weighting characteristics (e.g., by interchanging the weight positions with respect to one another and/or the club head body member).

Additional aspects of this invention relate to golf club structures that include golf club heads, e.g., of the types described above. Such golf club structures further may include one or more of: a shaft member attached to the club head (optionally via a separate hosel member or a hosel member provided as an integral part of one or more of the club head or shaft); a grip or handle member attached to the shaft member; additional weight members; etc.

Still additional aspects of this invention relate to methods for producing golf club heads and golf club structures, e.g., of the types described above. Such methods may include, for example: (a) providing a golf club head of the various types described above, e.g., by manufacturing or otherwise constructing the golf club head body, by obtaining the golf club head body from another source, etc.; and (b) engaging a first weight member with the golf club head body at a first weight receiving portion defined in the golf club head body, e.g., at a top portion of a perimeter weight member included with the club head body. Methods according to the invention further may include engaging a second weight member with a second weight receiving portion defined in the club head body (e.g., in the perimeter weight member, in the sole, etc.). The weight members and the weight receiving portions may be structured such that the first weight member is engagable with the golf club head body at each of the first and second weight receiving positions and the second weight member is engagable with the golf club head body at each of the first and second weight receiving portions (i.e., the weight members may be interchangeably mounted in the different weight receiving portions). In this manner, if the first and second weight members have different weighting characteristics from one another (e.g., different masses, different densities, different weight distributions, etc.), the center of gravity location of the club head can be selectively altered, e.g., to better fit a user's swing characteristics, to better match weather conditions, to better match golf course conditions, etc. Methods according to examples of this invention may include additional steps, such as engaging a shaft member with the golf club head; engaging a grip member with the shaft member; etc. Other steps also may be included in these methods, such as club head body finishing steps, application of additional weight members, etc.

BRIEF DESCRIPTION OF THE DRAWINGS

The present invention is illustrated by way of example and not limited in the accompanying figures, in which like reference numerals indicate similar elements throughout, and in which.

Figure 1:
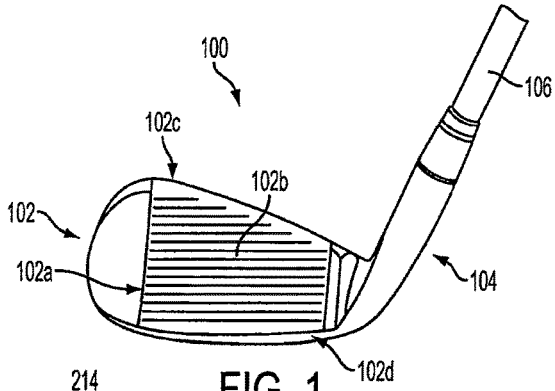
FIG. 1 generally illustrates features of a golf club structure according to at least some examples of this invention.

The reader is advised that the various parts shown in these drawings are not necessarily drawn to scale.

DETAILED DESCRIPTION

The following description and the accompanying figures disclose features of golf club heads and golf clubs in accordance with examples of the present invention.

I. General Description of Example Golf Club Heads, Golf Clubs, and Methods in Accordance with this Invention As described above, aspects of this invention relate to iron-type golf club heads and golf clubs. Iron-type golf club heads according to at least some example aspects of this invention may include: (a) an iron-type golf club head body; (b) a ball striking face; (c) a rear surface opposite the ball striking face, optionally including a perimeter weighting member extending rearward from the ball striking face and along at least a portion of a circumferential area of the golf club head body, wherein the rear surface (e.g., the perimeter weighting member) defines at least a first weight receiving portion (e.g., along a top portion of the rear surface (e.g., the perimeter weighting member)); and (d) a first weight member engaged with the first weight receiving portion, e.g., in a removable manner. In some example structures, the first weight member may have a density and/or a weight that is greater than the corresponding density and/or weight of the club head body material (e.g., the material of the perimeter weighting member) that it replaces (e.g., a greater density and/or mass than a correspondingly sized and shaped piece of material made from the material of the club head body (e.g., the material of the perimeter weighting member). In other structures, the first weight member may have a density and/or weight that is lower than the corresponding density or weight of the club head body material (e.g., the material of the perimeter weighting material) that it replaces (e.g., a lower density and/or mass than a correspondingly sized and shaped piece of material made from the material of the perimeter weighting member or other portion of the club head body).

Golf club head structures in accordance with at least some examples of this invention further may include a golf club body that defines a second weight receiving portion independent of the first weight receiving portion (e.g., in the perimeter weighting member, in the sole portion of the club head, etc.). In such structures, the first weight member may be removably engaged with the golf club head body at one of the first or second weight receiving portions (and it may be engagable with the golf club head body at each of the first and second weight receiving portions). The club head further may include a second weight member removably engaged with the golf club head body at one of the first or second weight receiving portions (and this second weight member also may be removably engagable with the golf club head body at each of the first and second weight receiving portions). The first and second weight members may be constructed to have different weighting characteristics from one another. At any given time, the first and second weight members will be engaged with different weight receiving portions on the club head body, and the weight members and the weight receiving portions may be designed and structured so that the weight members can be readily interchanged in position on the overall golf club head structure.

The weight members may be of substantially the same size, shape, and/or structure so as to make them interchangeable, as described above. In some examples, the weight members have different weights, different densities, different weight distributions, and/or other different weighting characteristics. Therefore, the interchangeability of these weight members on the golf club head body may affect the center of gravity position of the golf club head when the weight members are positioned at particular locations of the golf club head.

The weight members may be engaged with the club head body in a variety of different manners, orientations, and the like without departing from this invention. For example, in some structures, the weight members may be provided as part of the perimeter weighting member of the golf club head body, optionally at least along the top portion of the perimeter weighting member and along the sole (e.g., as part of a bottom portion of the perimeter weighting member) of the golf club head body. In other example structures, plural weight members may be provided at each of the top portion of the perimeter weighting member and along the sole (e.g., as part of the bottom portion of the perimeter weighting member). In still other example structures, the weight members may form a substantial portion of at least one of the top of the perimeter weighting member, the bottom of the perimeter weighting member, and/or the sole of the club head structure.

Also, the specific structure of the weight members and the weight receiving portions may vary without departing from this invention. For example, if desired, the weight members may be engaged with the golf club head body via weight receiving ports defined in the golf club head body (e.g., in a perimeter weight, in the sole, etc.). In other example structures, however, the weight receiving portion may simply define an open gap in the perimeter weighting member and the corresponding weight member(s) may fit into and fill the gap in the perimeter weighting member. Other structures and arrangements of the weights and/or weight receiving members are possible without departing from this invention.

Additional aspects of this invention relate to iron-type golf club structures that include golf club heads, e.g., of the types described above. Such iron-type golf club structures further may include one or more of: a shaft member attached to the club head (optionally via a separate hosel member or a hosel member provided as a part of one or more of the club head and/or shaft); a grip or handle member attached to the shaft member; additional weight members; medallions; etc.

Still additional aspects of this invention relate to methods for producing iron-type golf club heads and iron-type golf club structures in accordance with examples of this invention. Such methods may include, for example, one or more of the following steps in any desired order and/or combinations: (a) providing a golf club head body and/or a golf club head of the various types described above (including any or all of the various structures, features, and/or arrangements described above), e.g., by manufacturing or otherwise constructing the golf club head body or the golf club head, by obtaining it from a third party source, etc.; (b) engaging a shaft member with the golf club head; (c) engaging a grip member with the shaft member; (d) engaging a first weight member with the golf club head body at one of a first or second weight receiving portions, wherein the first weight member is engagable with the golf club head body at each of the first and second weight receiving portions; and/or (e) engaging a second weight member with the golf club head body at one of the first or second weight receiving portions, wherein the second weight member is engagable with the golf club head body at each of the first and second weight receiving portions; and wherein the first and second weight members are engaged with different weight receiving portions. As described above, the first and second weight members may have different weighting characteristics from one another to thereby enable selective control of the overall weighting characteristics of the golf club head.

Given the general description of various example aspects of the invention provided above, more detailed descriptions of various specific examples of golf clubs and golf club head structures according to the invention are provided below.

II. Detailed Description of Example Golf Club Heads, Golf Club Structures, and Methods According to the Invention The following discussion and accompanying figures describe various example golf clubs and golf club head structures in accordance with the present invention. When the same reference number appears in more than one drawing, that reference number is used consistently in this specification and the drawings to refer to the same or similar parts throughout.

More specific examples and features of iron-type golf club heads and golf club structures according to this invention will be described in detail below in conjunction with the example golf club structures illustrated in FIGS. 1 through 9B.

FIG. 1 generally illustrates an example of an iron-type golf club 100 and/or golf club head 102 in accordance with the present invention. In addition to the golf club head 102, the overall golf club structure 100 of this example includes a hosel region 104, a shaft member 106 received in and/or inserted into and/or through the hosel region 104, and a grip or handle member (not shown) attached to the shaft member 106. Optionally, if desired, the external hosel region 104 may be eliminated and the shaft member 106 may be directly inserted into and/or otherwise attached to the head member 102 (e.g., through an opening provided in the top of the club head 102, through an internal hosel member (e.g., provided within an interior chamber defined by the club head 102), etc.). The hosel member 104 may be integrally formed as part of the club head structure 102, or it may be separately formed and engaged therewith (e.g., by adhesives or cements; by welding, brazing, soldering, or other fusing techniques; by mechanical connectors; etc.). Conventional hosels and their inclusion in an iron type club head structure may be used without departing from this invention.

The shaft member 106 may be received in, engaged with, and/or attached to the club head 102 in any suitable or desired manner, including in conventional manners known and used in the art, without departing from the invention. As more specific examples, the shaft member 106 may be engaged with the club head 102 via a hosel member 104 and/or directly to the club head structure 102, e.g., via adhesives, cements, welding, soldering, mechanical connectors (such as threads, retaining elements, or the like), etc.; through a shaft-receiving sleeve or element extending into the club head body 102; etc. If desired, the shaft 106 may be connected to the head 102 in a releasable manner using mechanical connectors to allow easy interchange of one shaft for another on the head.

The shaft member 106 also may be made from any suitable or desired materials, including conventional materials known and used in the art, such as graphite based materials, composite or other non-metal materials, steel materials (including stainless steel), aluminum materials, other metal alloy materials, polymeric materials, combinations of various materials, and the like. Also, the grip or handle member (not shown) may be attached to, engaged with, and/or extend from the shaft member 106 in any suitable or desired manner, including in conventional manners known and used in the art, e.g., using adhesives or cements; via welding, soldering, brazing, or the like; via mechanical connectors (such as threads, retaining elements, etc.); etc. As another example, if desired, the grip or handle member (not shown) may be integrally formed as a unitary, one-piece construction with the shaft member 106. Additionally, any desired grip or handle member materials may be used without departing from this invention, including, for example: rubber materials, leather materials, rubber or other materials including cord or other fabric material embedded therein, polymeric materials, and the like.

The club head body 102 itself also may be constructed in any suitable or desired manner and/or from any suitable or desired materials without departing from this invention, including from conventional materials and/or in conventional manners known and used in the art. For example, in the example structure shown in FIG. 1, the club head body 102 includes a ball striking face member 102*a* (including a ball striking face plate 102*b* integrally formed with the face member 102*a* or attached to a frame member such that the face plate 102*b* and frame member together constitute the overall face member 102*a*). The club head body 102 of this illustrated example further includes a top portion 102*c* and a sole portion 102*d*. The club head body 102 and/or its various parts may be made by forging, casting, molding, and/or using other techniques and processes, including techniques and processes that are conventional and known in the art.

A wide variety of overall club head constructions are possible without departing from this invention. For example, if desired, some or all of the various individual parts of the club head body 102 described above may be made from multiple pieces that are connected together (e.g., by adhesives or cements; by welding, soldering, brazing, or other fusing techniques; by mechanical connectors; etc.). The various parts (e.g., top portion 102*c*, sole portion 102*d*, etc.) may be made from any desired materials and combinations of different materials, including materials that are conventionally known and used in the art, such as metal materials, including lightweight metal materials, composite materials, polymer materials, etc.

The dimensions and/or other characteristics of a golf club head structure 102 according to examples of this invention may vary significantly without departing from the invention. For example, any iron type club head may be provided including, for example: iron type hybrid clubs, driving irons, 0 through 10 irons, wedges (e.g., pitching wedges, lob wedges, gap wedges, sand wedges, etc.), chipping clubs, etc.

Figure 2A:
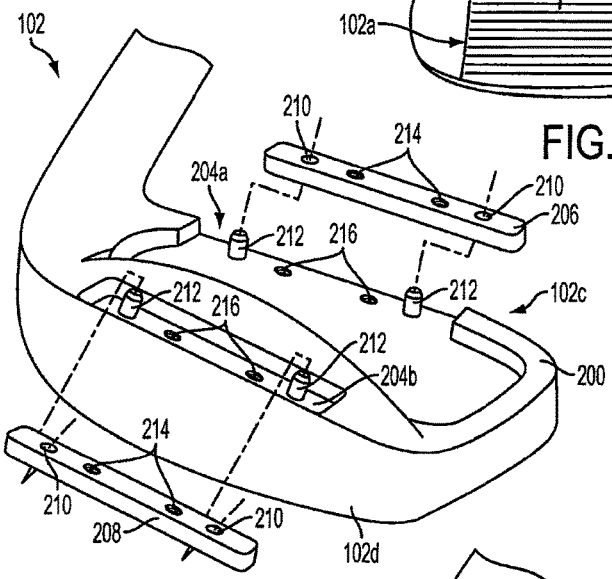
FIGS. 2A and 2B illustrates a golf club head structure including interchangeable weight members in accordance with at least one example of this invention.

FIG. 2A illustrates additional example features and structures that may be included in golf clubs 100 and golf club head body structures 102 in accordance with examples of this invention. As shown in this figure, a perimeter weighting member 200 extends rearward from the ball striking face and along at least a portion of a circumferential area of the golf club head body 102. The perimeter weighting member 200 defines a first weight receiving portion 204*a* and the golf club head body 102 defines a second weight receiving portion 204*b* that is independent of the first weight receiving portion 204*a*. While the weight receiving portions 204*a* and 204*b* may take on a wide variety of forms without departing from this invention, e.g., a notch, recess, open space, cavity, chamber, etc., in this illustrated example structure 102, the weight receiving portion 204*a* constitutes a recess or open space (gap) in the perimeter weight member structure, and the weight receiving portion 204*b* constitutes a cavity or chamber defined in the lower portion of the perimeter weight member 200 (in, at, or near the club sole portion 102*d*).

In this illustrated example, a first weight member 206 may be removably engaged with the golf club head body 102 at the first weight receiving portion 204*a*. Similarly, a second weight member 208 may be removably engaged with the golf club head body 102 at the second weight receiving portion 204*b*. The first weight member 206 (as well as the weight receiving portions 204*a* and 204*b*) may be structured (e.g., sized and shaped) so that the weight member 206 may be engagable with the golf club head body 102 at each of the first weight receiving portion 204*a* and the second weight receiving portion 204*b*. The second weight member 208 also may be structured (e.g., sized and shaped) so as to be engagable with the golf club head body 102 at each of the first weight receiving portion 204*a* and second weight receiving portion 204*b*. In this way, the weight members 206/208 are interchangeable with one another and with respect to the weight receiving portions 204*a*/204*b*.

Figure 2B:
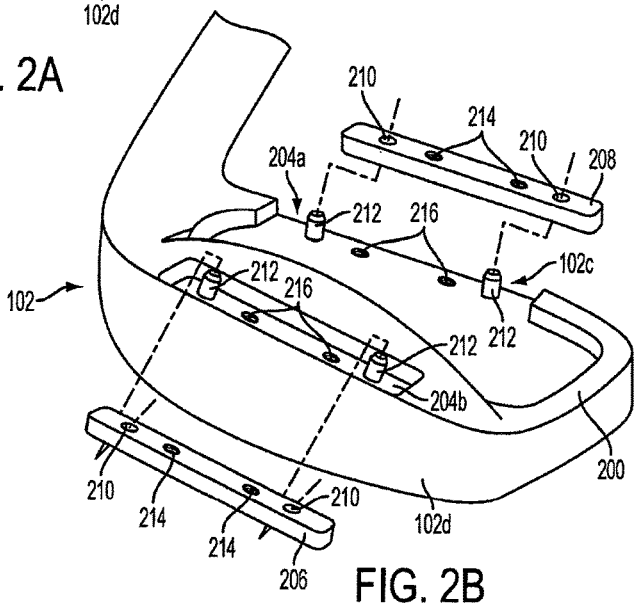

A comparison of FIGS. 2A and 2B illustrates an example of this interchangeability feature. As shown in FIG. 2A, the first weight member 206 (having a first set of weighting characteristics) may be attached to the first weight receiving portion 204*a*, and the second weight member 208 (having a different set of weighting characteristics) may be attached to the second weight receiving portion 204*b*. As shown in FIG. 2B, however, the first weight member 206 may be attached to the second weight receiving portion 204*b*, and the second weight member 208 also may be attached to the first weight receiving portion 204*a*. Because the first weight member 206 may have a different weight, density, or other weighting characteristics as compared with the second weight member 208, positioning of the weight members 206 and 208 with respect to the weight receiving portions 204*a* and 204*b* can be used to selectively control features of the club head's center of gravity, as will be explained in more detail with respect to FIGS. 9A and 9B.

The weight members 206 and 208 may be engaged with the weight receiving portions 204*a* and 204*b* in a wide variety of different manners without departing from this invention. For example, in the example structure 102 illustrated in FIG. 2A, weight engaging members 212 fit into corresponding holes 210 defined in the weight members 206/208, wherein together the weight engaging members 212 and the holes 210 aid in positioning and engaging the weight members 206/208 with respect to the golf club head body 102. Additionally, in this example structure 102, threaded holes 214 are included in the weight members, and corresponding threaded holes 216 are included in the golf club head body 102. A threaded fastener (not shown) engages the threaded holes 214/216 to further aid in attaching the weight members 206 and 208 to the club head body 102. If desired, one set of these engagement aids (e.g., engaging members 212 and/or threaded holes 214/216) may be omitted without departing from the invention.

In addition to or as an alternative to the threaded connection system (using screws engaged with threaded holes 214/216) shown in FIGS. 2A and 2B, the weight engaging members 212 may be press fit (or otherwise engaged) with the openings 210 provided in the weight members 206 and 208. If desired, the free ends of the weight engaging members 212 may be provided with deformable end portions that expand outward after extending through the holes 210 to help fix the weight members 206 and 208 to the weight engaging members 212. In some structures, the deformable free end portions of the weight engaging members 212 simply may be flexible enough to allow their insertion into and removable from openings 210 without the need for tools or mechanical manipulation of the free ends, although tools may be provided and used for this purpose, if desired. As additional examples, the weight engaging members 212 may include one or more raised surfaces that fit into grooves provided in the interior surface of the openings 210 or extend outward over the end surface of the openings 210. As yet additional examples, other types of mechanical connection systems may be utilized to engage the weight members 206/208 to the weight receiving portions 204*a*/204*b* such that a tool is needed to assist in engaging and releasing the weights (e.g., a screwdriver or allen wrench type of tool, a tool to release spring loaded retaining elements, a torque wrench, a gripping device that engages the weight and allows the user to pull the weight away from the club head body, etc.).

Figure 3:
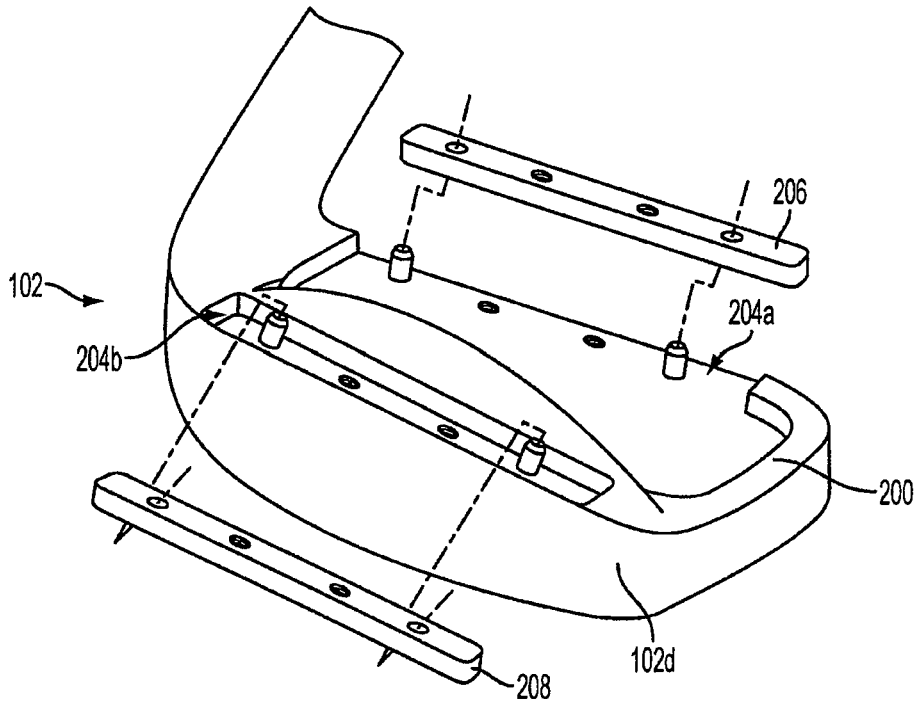
FIG. 3 illustrates another example golf club head structure including interchangeable weight members in accordance with this invention.

The weight members and their respective receiving portions and engaging mechanisms may be formed in a variety of ways. Another example structure is shown in FIG. 3. As illustrated in this figure, the first weight member 206 and the first weight receiving portion 204*a* may extend almost the entire length of the top perimeter portion of the perimeter weighting member 200 of the golf club head body 102. Similarly, the second weight member 208 and the second weight receiving portion 204*b* in this example structure 102 extend almost the entire length of the bottom perimeter portion of the perimeter weighting member 200 of the golf club head body 102. Any desired length of weight members 206/208 and corresponding weight receiving portions 204*a*/204*b* may be used without departing from this invention.

Figure 4:
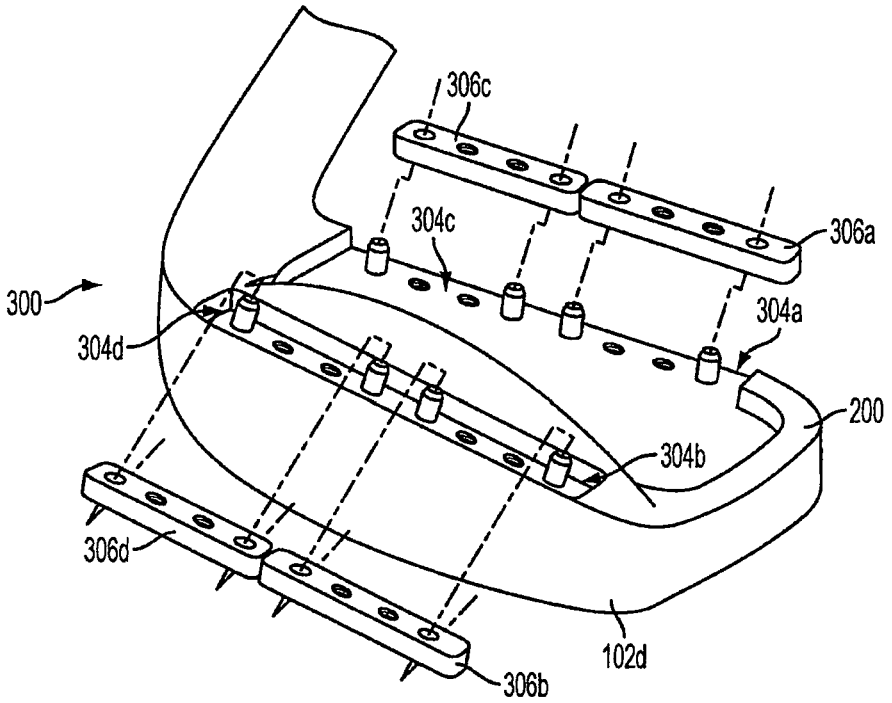
FIG. 4 illustrates another example golf club head structure including interchangeable weight members in accordance with this invention.

Many other variations in the club head weighting system are possible without departing from this invention. Another example structure is shown in FIG. 4. As illustrated in this figure, the golf club head 300 may include a plurality of weight receiving portions 304*a*-304*d* and a plurality of weight members 306*a*-306*d* may be provided. While each of the plurality of weight members 306*a*-306*d* may have different weights, densities, weight distributions, and/or other weighting characteristics, if desired, two or more of the weight members 306*a*-306*d* may have the same weighting characteristics without departing from this invention. In this illustrated example structure 300, plural weight members 306*a* and 306*c* are engaged with the top perimeter portion of the perimeter weighting member 200 (at weight receiving portions 304*a* and 304*c*), and plural weight members 306*b* and 306*d* are engaged with the bottom perimeter portion of the perimeter weighting member 200 (at weight receiving portions 304*b* and 304*d*). In this illustrated example structure 300, each of the plurality of weight members 306*a*-306*d* may be interchangeably engaged with any of the plurality of weight receiving portions 304*a* through 304*d*. In this way, the center of gravity of the club head 300 may be adjusted both vertically and horizontally (assuming that at least some of the weight members 306*a*-306*d* have different weighting characteristics).

It is not a requirement that each of the weight members 306*a* through 306*d* be interchangeably mountable in each of the weight receiving portions 304*a* through 304*d*. Rather, if desired, the various weight members and weight receiving portions may be structured, sized, and/or shaped such that two (or more) of the weights (e.g., weights 306*a* and 306*b*) are interchangeable with respect to one another but not with respect to all of the other weight members (e.g., weights 306*c* and 306*d*), and some of the other weight members (e.g., weights 306*c* and 306*d*) are interchangeable with respect to one another. Any desired arrangement and/or numbers of interchangeable weights, weight receiving portions, and/or interchangeability may be provided without departing from this invention.

FIG. 4 further illustrates the adjacent weight members (e.g., 306*a* and 306*c*; 306*b* and 306*d*) very close to or even in contact with one another. This is not a requirement. Rather, if desired, the adjacent weight members (e.g., 306*a* and 306*c*; 306*b* and 306*d*) may be separated from one another, e.g., by a gap or space, by an intermediate portion of the perimeter weighting member 200, by an intermediate portion of the sole member 102*d*, by an independent "spacer" member, etc., without departing from this invention. The weight members 306*a* through 306*d* (as well as the other example weight members described above in conjunction with FIGS. 2A through 3 and those described below) also need not be linearly and/or rectangular cubic shaped, but they may be curved, arched, rounded, multi-leveled, stepped, etc.

While FIG. 4 generally illustrates the same type of connection systems for weight members 306*a* through 306*d* as those illustrated in conjunction with FIGS. 2A through 3, other connection systems may be used without departing from this invention, including, for example, any of the variations on the connection systems described above. Also, while they may be structured to be the same, there is no requirement that all of the various plural weight members on an individual club head use the same type of connection system. Rather, if desired, one or more of the weight members and/or weight receiving portions may use one type of connection system while one or more of the other weight members and/or weight receiving portions may use a different type of connection system.

FIGS. 2A through 4 illustrate at least one of the weight members (e.g., upper weight member 206) constituting an entire expanse or stretch of the perimeter weight member 200 (e.g., the weight member 206 has a size and shape to form at least a portion of the top portion of the perimeter weight member 200). This is not a requirement. For example, as illustrated in FIGS. 2A through 3, the lower weight member 208 fits into a cavity, recess, or chamber defined in the lower portion of the perimeter weight member 200 (or in the sole member 102*d*). The upper weight member 206 also may fit into such a cavity, recess, or chamber defined in the upper portion of the perimeter weight member 200 (e.g., if the club head was constructed more like a blade type iron as opposed to a perimeter weighted, cavity back type iron).

Figure 5:
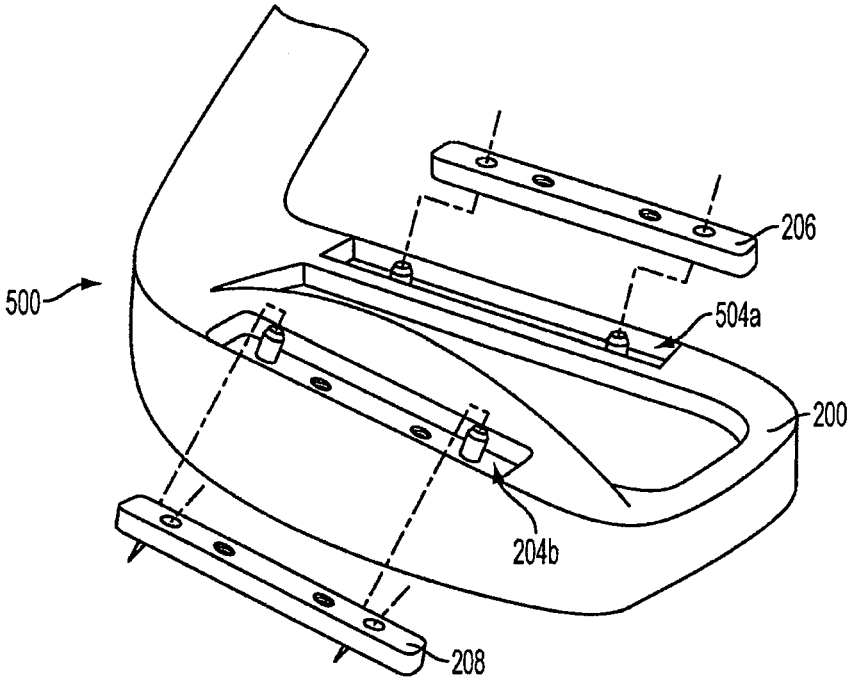
FIG. 5 illustrates still another golf club head structure including interchangeable weight members in accordance with an example of this invention.
Figure 6:
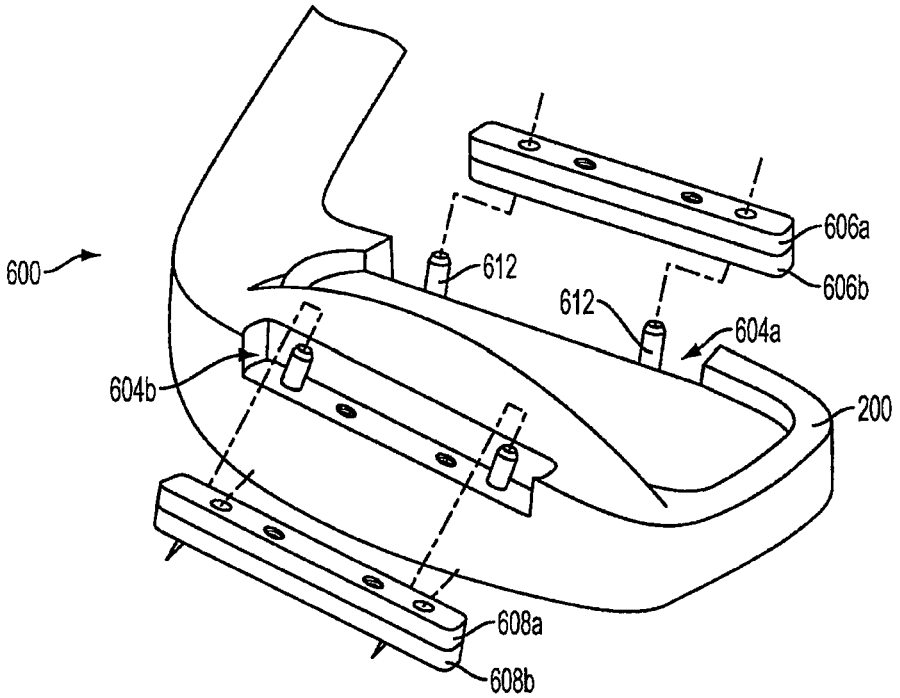
FIG. 6 illustrates another example golf club head structure including interchangeable weight members in accordance with this invention.

FIG. 5 illustrates another example of this type of connection. As shown in FIG. 5, the top portion of the perimeter weighting member 200 of this example club head structure 500 includes a cavity, chamber or recess 504*a* defined therein. In this illustrated example structure 500, the perimeter weighting member 200 includes a second weight receiving cavity, chamber or recess 204*b* positioned along the bottom of the perimeter weighting member 200, in a manner similar to the structures illustrated in FIGS. 2A through 3. As in the previously described structures, the first cavity, chamber, or recess 504*a* of this example structure 500 may accommodate either the first weight member 206 or the second weight member 208. Likewise, the second cavity, chamber, or recess 204*b* may accommodate either the first weight member 206 or the second weight member 208.

Also, while not shown, a plurality of cavities, chambers or recesses may be included in the club head structure, e.g., such that plural cavities, recesses, or chambers are provided at each of the top perimeter portion of the perimeter weighting member and the bottom perimeter portion of the perimeter weighting member or in the sole portion of the club head structure. In this way, a plurality of weight members may be provided at each of the top perimeter portion of the perimeter weighting member and the bottom perimeter portion of the perimeter weighting member (e.g., in a manner akin to the weighting structure shown in FIG. 4, except with chambers provided in the upper portion of the perimeter weighting member rather than in an open space or gap provided in the perimeter weighting member).

Still other weighting configurations are possible without departing from this invention. The example golf club head structure 600 of FIG. 6 includes two weight receiving portions 604*a* and 604*b* (one located along the top perimeter of the club head 600 and one located along the bottom sole portion of the club head 600), and two (or optionally more) stacked weights are provided in each of the weight receiving portions 604*a* and 604*b* (e.g., in this illustrated example, weights 606*a* and 606*b* are provided in the upper weight receiving portion 604*a* and weights 608*a* and 608*b* are provided in the lower weight receiving portion 604*b*). While not shown in FIG. 6, the weight engaging members 612 at the top portion of the perimeter weight member 200 are provided on (e.g., attached to, integrally formed with, etc.) a rear surface of a ball striking face that may be separately provided and engaged with the remainder of the club head body (which includes the perimeter weighting member 200), e.g., by welding, soldering, brazing, or other fusing techniques; by adhesives or cements; by mechanical connectors; etc., in a manner as is conventionally known and used in the art. Alternatively, if desired, the ball striking face may be integrally formed with the perimeter weighting member 200 and/or other portions of the club head structure.

In this illustrated example structure 600, all of the weight members 606*a*, 606*b*, 608*a*, and 608*b* are sized and shaped so as to be completely interchangeable with one another in any desired arrangement. In this manner, weighting characteristics of the club head 600 may be selectively altered by: (a) interchanging locations of weight members within an individual stack (e.g., interchanging the stacked locations of weight members 606*a* and 606*b* in this illustrated example); (b) interchanging locations of weight members located top to bottom (e.g., interchanging the locations of weight 606*a* or 606*b* with either of weights 608*a* or 608*b*); and/or (c) flipping one or more weight members 606*a*, 606*b*, 608*a*, and/or 608*b* end for end (if the weight members have different weight distributions along their longitudinal length (e.g., one end heavier than the other, etc.)). These features allow further fine tuning and selective control of the club head's weighting characteristics.

While all of the weight members 606*a*, 606*b*, 608*a*, and 608*b* may have different weights, densities, and/or weight distributions with respect to one another, if desired, two or more of the weight members may possess the same weight, density, and/or weight distribution without departing from this invention. Also, other ways of mechanically connecting the weight members 606*a*, 606*b*, 608*a*, and 608*b* to the club head body may be used without departing from this invention, including the various alternative ways described above.

Figure 7:
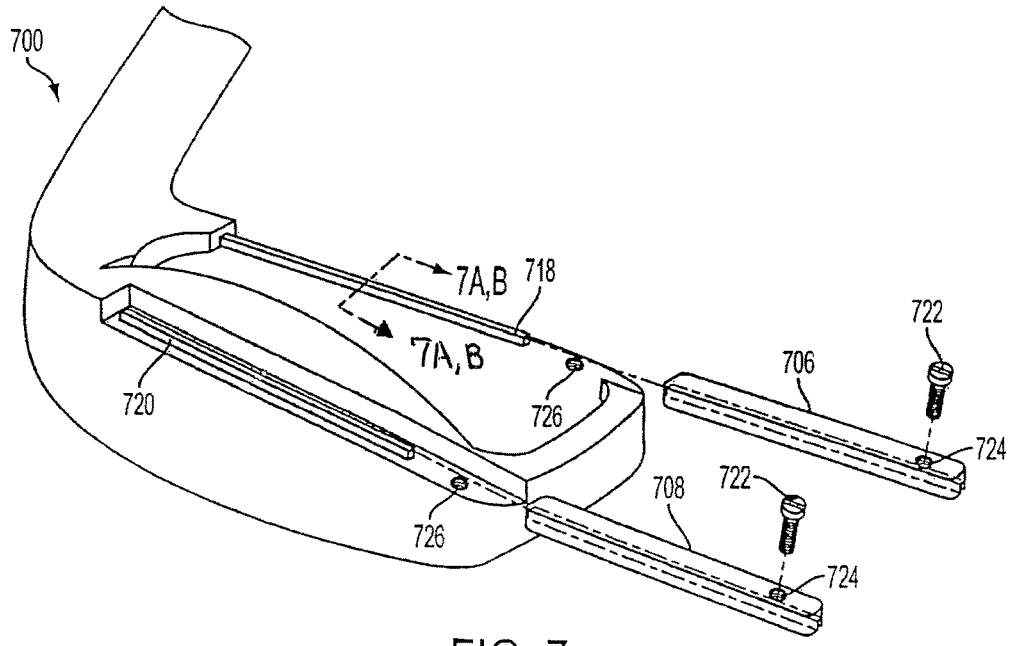
FIGS. 7, 7A, and 7B illustrate additional example golf club head structures including slidable interchangeable weight members in accordance with this invention.
Figure 7B:
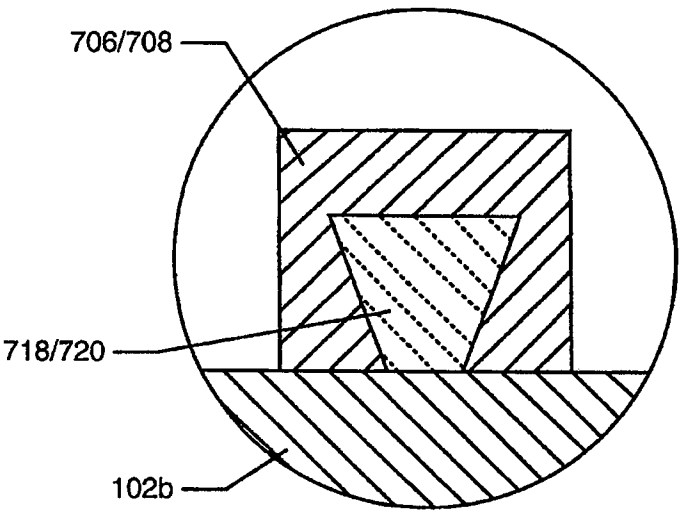
Figure 7A:
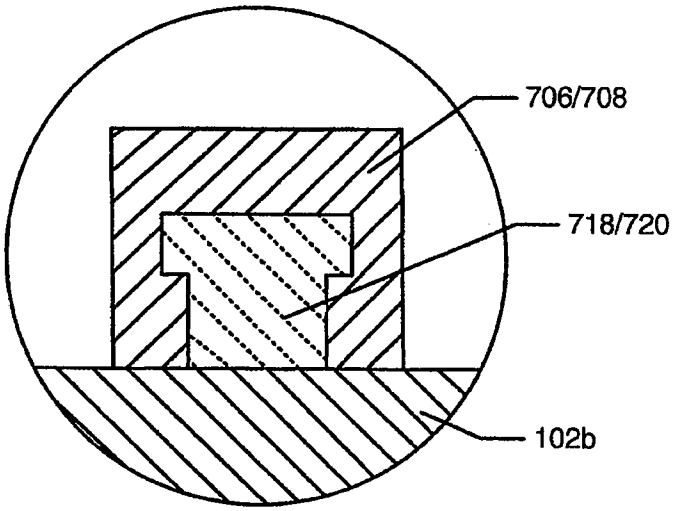

As described above, a wide variety of ways of engaging the weight members with the golf club head body are possible without departing from the invention. FIG. 7 shows yet another example engaging system that may be used in structures according to some examples of this invention. As shown in FIG. 7, first and second weight members 706/708 in this club head structure 700 are engaged with the golf club head body 700 via sliding rails or tracks 718 and 720 defined in or engaged with the golf club head body 702. The weight members 706 and 708 include grooves defined therein that slide over the rails 718 and 720. The grooves and rails may be sized and shaped such that the weight members 706 and 708 will not lift off the rails 718 and 720 (e.g., having a "keyed" structure, having some upper portion of the rails and the grooves with a larger dimension than the bottom portion of the rail or groove, providing rails and grooves with one or more stepped or angled side walls, etc.). See FIGS. 7A and 7B, which illustrate sectional views of weight members 706/708 mounted on rails or tracks 718/720. In addition (or alternatively), friction fitting projections and/or detents may be provided in either weight members 706/708 and/or the club head body, in order to firmly secure the weight members 706/708 to the golf club head 700. If desired, the projections may be spring loaded to extend outward and a tool may be provided to release the spring and allow disengagement of the weight members 706/708 from the club head body 700.

As shown in FIG. 7, the weight members 706/708 may be held in place by one or more threaded connectors (e.g., screws 722) that engage threaded holes 724/726 provided in the club head body 700. Any number of threaded connectors may be provided, at any desired positions on the weight members 706/708 (e.g., along their longitudinal lengths), without departing from this invention.

These examples of engagements of the weight members 706/708 with the golf club head body are merely illustrative and should not be considered as limiting. As further examples, the weight members may be engaged onto the golf club head body via a variety of mechanical or magnetic fasteners. Further, the weight member(s) may be held in place in any desired manner, including in a releasable or removable manner, etc., including through the use of mechanical connectors (e.g., screws, bolts, spring-loaded retaining elements, detents, friction fits, etc.), and the like. The weight members may be disengaged from the golf club head body in a variety of ways, including via manual or mechanical manipulations and structures, such as via jacking screws. In at least some example structures according to this invention, a tool will be required to completely engage and/or disengage the weight members from the club head body. Examples of such tools may include, but are not limited to: screw drivers, allen wrenches, torque wrenches, tools to assist in engaging and pulling the weight members off the club head body, etc.

Figure 8:
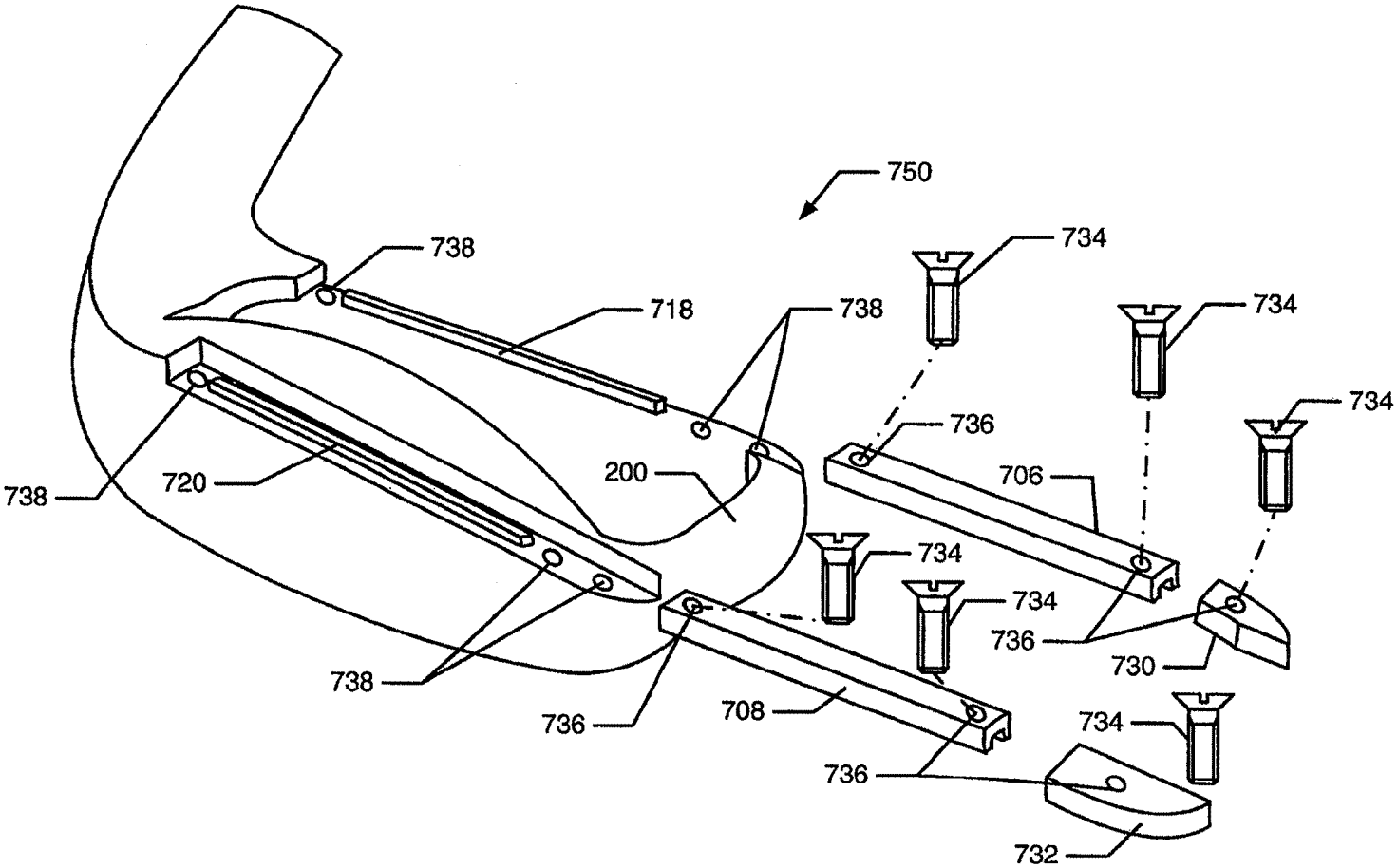
FIG. 8 illustrates another example golf club head structure including slidable interchangeable weight members in accordance with this invention.

Retaining members also may be used to at least partially help hold the weight members in place with respect to the remainder of the club head body. For example, in the structure 750 illustrated in FIG. 8, as described above in conjunction with FIG. 7, the weight members 706/708 slide onto the club head body over rails 718/720. Once slid into place, the weight members 706/708 may be secured at the desired position by engaging an end cap member 730/732 to the club head body 700 adjacent the free ends of the weight members 706/708. The end cap members 730/732 may have a structure and/or shape (and may be made from a suitable material) so as to appear and act like a continuation of the perimeter weighting member 200. Also, if desired, at least some portion of the end cap member and/or other type of retaining member may extend over the weight member to help hold the weight member in place. The end cap members 730/732, when present, may be engaged with the club head structure 700 in any desired manner, e.g., through screw or other threaded type fasteners, through mechanical connectors, etc. As a more specific example, as illustrated in FIG. 8, threaded members 734 (e.g., bolts, screws, etc.) may engage threaded openings 736 and/or 738 provided in the end cap members 730/732 and/or the club head body. When movement of the weight members 706/708 is desired, the end cap members 730/732 may be removed from the club head body, the weight members 706/708 may be interchanged with one another (and/or interchanged with other weights), and the end cap members 730/732 then can be replaced.

Additionally or alternatively, if desired, the weight members 706/8708 also may be engaged with the club head body member via similar threaded engagement systems 734, 736, and/or 738.

Figure 9A:
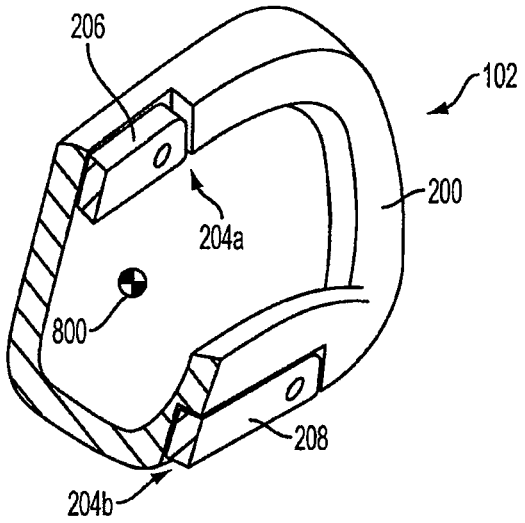
FIGS. 9A and 9B illustrate a golf club head body having different center of gravity locations depending on the positioning of different weight members engaged with the golf club head body.
Figure 9B:
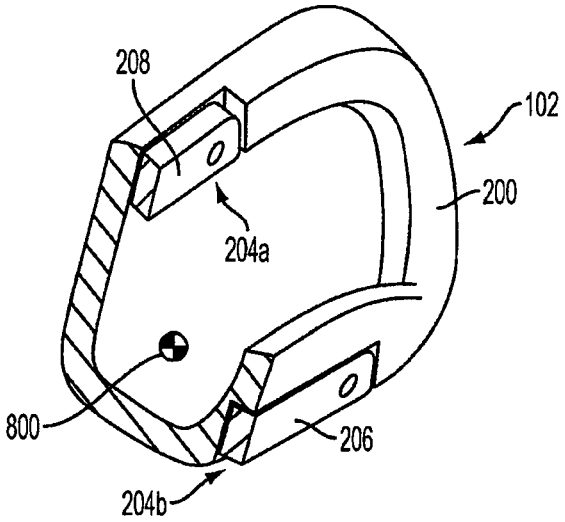

As described above, the interchangeability of the weight members allows the weight members to be "switched" in regard to their positions of engagement with the golf club head. Also as described above, the various weight members may have different weights, densities, weight distributions, and/or other weighting characteristics (e.g., first weight member 206 may be made from a higher density material and may weigh more than the second weight member 208). In this manner, the interchangeability of the different weight members can lead to changes in the center of gravity position of the golf club head. FIGS. 9A and 9B generally illustrate different potential centers of gravity for different arrangements of the first and second weight members engaged with the golf club head. In the example arrangement shown in FIG. 9A, the first weight member 206 has a higher density and is a heavier weight than the second weight member 208. As shown in FIG. 9A, the first weight member 206 is engaged at the first weight receiving portion 204*a* in the upper portion of the club head body, and the second weight member 208 is engaged at the second weight receiving portion 204*b* in the lower portion of the club head body. The center of gravity of this arrangement is denoted symbolically at reference number 800 in FIG. 9A. As shown in FIG. 9B, on the other hand, the first weight member 206 is engaged with the second weight receiving portion 204*b*, and the second weight member 208 is engaged with the first weight receiving portion 204*a*. The center of gravity of this arrangement is denoted symbolically in FIG. 9B at reference number 800. By comparing FIGS. 9A and 9B, one can see that the center of gravity of the club head when configured in the first arrangement (FIG. 9A) is higher than the center of gravity of the club head when configured in the second arrangement (FIG. 9B). This change in the center of gravity of the club head can affect the trajectory and ball flight of a golf ball struck by the golf club. For example, the configuration which produces a lower center of gravity (FIG. 9B) can provide a higher trajectory golf ball flight path. It is typically easier for at least some users to get a golf ball airborne using a club head having a lower center of gravity, and therefore, providing significant weight located lower and toward the club head rear can assist these users. Such an arrangement also can be useful in certain play conditions and/or on certain golf courses in order to provide a higher ball flight (e.g., to make balls fly higher, produce more spin, for quicker stopping action, etc.). Conversely, the configuration which produces a higher center of gravity in the golf club head (FIG. 9A) can provide a more boring golf ball flight path, e.g. for play in windy conditions, to provide more "running" shots, and/or to help compensate for swing flaws that typically produce an excessively high ballooning flight.

The movable weighting features of golf club heads in accordance with this invention are not limited to controlling the vertical position of the golf club's center of gravity (the vertical position when the golf club is oriented at a ball addressing position). Rather, as described above in conjunction with FIG. 4, the center of gravity in the heel-to-toe direction also may be selectively controlled, if desired, in at least some examples of golf club head structures according to this invention. By increasing the weight in the heel area of the club head (e.g., by providing heavier weights toward the hosel in the example structure shown in FIG. 4), the club head may be made somewhat "heel heavy," which can fade bias the club (i.e., make the club more disposed to producing a left-to-right ball flight for right handed golfers) and/or it may help compensate for swing flaws for golfers that tend to consistently hook the ball. Conversely, by increasing the weight in the toe area of the club head (e.g., by providing heavier weights toward the toe in the example structure shown in FIG. 4), the club head may be made somewhat "toe heavy," which can draw bias the club (i.e., make the club more disposed to producing a right-to-left ball flight for right handed golfers) and/or it may help compensate for swing flaws for golfers that tend to consistently slice the ball. Shifting the club head's center of gravity in the heel-to-toe direction may be selectively controlled by changing the positions of the club head weights to make the club more toe heavy or heel heavy in the manner described above.

One need not interchange two different weights in order to selectively alter the club head's center of gravity in the heel-to-toe direction. Rather, the same general effect may be accomplished using a single weight member, like weight members 206 and/or 208 illustrated in FIG. 2A. If the weight member is made heavier at one end as compared to the other end (e.g., by including a weighted mass, such as lead or tungsten containing material, at one end, by making one end from a lightweight material as compared to the other end, by hollowing out one end as compared to the other end, etc.), the same general toe weighting and heel weighting effects can be accomplished by simply flipping the weight member(s) 206 and/or 208 end for end (e.g., to change the heavy end from the toe side to the heel side and vice versa). As another example, if desired, at least some portion of the heel and toe weighting effect (as well as top weighting and/or sole weighting) may be accomplished by using heavier weight securing systems at one side or end of the club head as compared to the other (e.g., heavier screws to hold the weights in place on one side as compared to the other).

The weight members may have indicators on them. These indicators may indicate particular characteristics about the weight members. Such characteristics may include the particular weight member's density, weight, weight distribution (e.g., heavy end, light end, etc.), etc. The indicators may include symbols, colors, alphanumeric characters, and the like. Such indicators could allow the user to easily identify a particular weight member and therefore easily position that weight member in an appropriate position for the desired club head characteristics.

In general, in the various golf club head structures described above, the weight members used in the club head structure were all present on the club head structure and interchangeable with one another from one position to another. It is not required, in at least all instances, that the weight members be interchanged exclusively with other weight members provided on the club head structure. Rather, if desired, additional weight members may be provided and kept separate from the club head structure, and a weight member included on the club head may be interchanged with one of these separately housed weights.

Any type of iron type golf club head structure may include one or more interchangeable weight structures of the types described above, including, for example: iron type hybrid clubs, driving irons, 0-10 irons, wedges (e.g., iron type clubs having lofts from 44-68 degrees, such as pitching wedges, lob wedges, sand wedges, gap wedges, etc.), chipping clubs, etc. If desired, in accordance with at least some examples of this invention, golf clubs and/or golf club heads in accordance with examples of this invention may be sold or marketed as a set including plural irons, including, for example, sets having two or more of iron type hybrid clubs, driving irons, 0-10 irons, pitching wedges, lob wedges, sand wedges, gap wedges, and/or chipping clubs. When present in a set, any desired number of the clubs in the set may have a club head with one or more interchangeable weight members in accordance with this invention. In some more specific examples, sets of golf clubs in accordance with this invention will contain at least the 3-9 irons and a pitching wedge, wherein at least 2 of these irons (and in some examples, all of these irons) will have a club head with one or more interchangeable weight members in accordance with examples of this invention. As another example, sets of golf clubs in accordance with this invention will contain at least the 4-9 irons (or even 5-9 irons or 6-9 irons) and a pitching wedge, and optionally a sand wedge and/or one or more iron type hybrid clubs, wherein at least 2 of these clubs (and in some examples, all of these clubs) will have a club head with one or more interchangeable weight members in accordance with examples of this invention.

Iron type golf club heads including one or more interchangeable weight members in accordance with examples of this invention are not limited for use with perimeter weighted and/or cavity back type clubs of the types illustrated in FIGS. 1-9B. Rather, if desired, interchangeable weights may be provided (e.g., in similar positions and/or arrangements) in blade type iron clubs or other iron type golf club head structures without departing from this invention. Rather than forming a portion of a perimeter weight member, in blade type clubs, the interchangeable weight member(s) may be located in at least one of the upper rear portion of the back side of the club, the lower rear portion of the rear portion of the back side of the club, the club sole, etc. The weight receiving portions in such blade type clubs may be "carved into" the rear surface of the club head structure, e.g., in a manner akin to the weight receiving portions illustrated in FIG. 5.

III. Conclusion

The present invention is described above and in the accompanying drawings with reference to a variety of example structures, features, elements, and combinations of structures, features, and elements. The purpose served by the disclosure, however, is to provide examples of the various features and concepts related to the invention, not to limit the scope of the invention. One skilled in the relevant art will recognize that numerous variations and modifications may be made to the embodiments described above without departing from the scope of the present invention, as defined by the appended claims. For example, the various features and concepts described above in conjunction with FIGS. 1 through 9B may be used individually and/or in any combination or subcombination without departing from this invention.

I claim:

1. A golf club head comprising:

an iron type golf club head body comprising a ball striking face, a top rail, a sole, a heel side, a toe side, a hosel, a perimeter weighting member extending rearward from the ball striking face and a rear surface opposite the ball striking face;

wherein the perimeter weighting member includes a heel perimeter portion extending around a heel side of the iron type golf club head body, a toe perimeter portion around the toe side of the iron type golf club head body, an open space at a top rail position of the iron type golf club head body, and a sole portion around a lower portion of the golf club head body when at address;

wherein the open space is a gap between the toe perimeter portion, the heel perimeter portion, and the rear surface;

wherein the heel perimeter portion and the toe perimeter portion of the perimeter weight member are integrally formed with the iron type golf club head body, wherein the rear surface includes a first rail positioned in a heel to toe direction, located in the open space at a top rail position of an upper portion of the perimeter weighting member of the golf club head when at address, wherein a chamber is formed in the sole portion of the perimeter weighting member of the golf club head when at address, a second rail positioned within the chamber formed in the sole portion of the perimeter weighting member in the heel to toe direction independent of the first rail a first weight member removably and slidably engaged with the iron type golf club head body along the first rail; and wherein the first weight member slidably engages with the iron type golf club body along the first rail by slidably engaging from a toe side end of the first rail horizontally parallel to the ball striking face toward a heel side end of the first rail, wherein the first weight member comprises the upper portion of the perimeter weighting member when slidably engaged with the iron type golf club head along the first rail, a second weight member removably and slidably engaged with the iron type golf club head body along the second rail;

wherein the second weight member slidably engages with the iron type golf club body along the second rail by slidably engaging from a toe side end of the second rail horizontally parallel to the ball striking face toward a heel side end of the second rail, wherein the second weight member comprises a portion of the sole of the iron type golf club body when slidably engaged with the second rail, wherein the first and second weight members have different weighting characteristics from one another but are substantially the same size, shape, and structure;

wherein interchanging the arrangement of the first and second weights with the first rail and the second rail adjust the center of gravity vertically when the golf club head is at address; and wherein adjusting the center of gravity vertically can affect the trajectory and ball flight of a golf ball struck by the golf club head;

wherein when the golf club head is at address, the first weight member and the second weight member include a groove on a front surface, and wherein the groove has an rear portion and a front portion, wherein the rear portion is larger than the front portion; and wherein the first and second rails have a rear portion and a front portion, wherein the rear portion is larger than the front portion; and the rear portion of the rail engages the rear portion of the groove on the weight member;

wherein when the first weight member or the second weight member are slidably engaged with the first rail or the second rail, the first or second weight member will not lift off the first or second rail.

2. A golf club head according to claim 1, wherein the first and second weight members are secured to the iron type golf club head body with at least one mechanical fastener.

3. A golf club head according to claim 1, wherein the first weight member has a first density and the iron type golf club head body has a second density, wherein the first density is higher than the second density.

4. A golf club head according to claim 1, wherein the first and second rails have at least one angled side wall.

5. A golf club head according to claim 1, wherein the first and second weight members are secured using an end cap, wherein the end cap has a surface shaped to act as a continuation of the toe side of the iron type golf club head body.

6. A golf club head according to claim 1, wherein the first and second weight members abut a surface of the heel perimeter portion of the perimeter weighting member.

7. A golf club head according to claim 1, wherein the first and second weight members include:

a longitudinal length configured to extend along the golf club head in a heel to toe direction when the first and second weight members are engaged with the golf club head;

a first longitudinal end; and a second longitudinal end opposite the first longitudinal end, wherein the first and second weight members have a weight distribution along their longitudinal length such that the first longitudinal end is heavier than the second longitudinal end.

8. A golf club head comprising:

an iron type golf club head body comprising a ball striking face, a top rail, a sole, a heel side, a toe side, a hosel, a back side including a heel portion, a portion of a sole surface, a toe portion, and a rear surface opposite the ball striking face;

wherein the heel portion and the toe portion of the golf club head are integrally formed with the iron type golf club head body, wherein when the golf club head is at address, the rear surface is positioned forward an outer surface of the back side of the heel portion of the iron type golf club head body and includes a first rail positioned in a heel to toe direction, located in an open space in the top rail of the golf club head when at address, and wherein the open space is a gap between the heel portion, the toe portion, and the rear surface;

wherein the first weight member slidably engages with the iron type golf club body along the first rail by slidably engaging from a toe side end of the first rail horizontally parallel to the ball striking face toward a heel side end of the first rail, a second rail positioned in the heel and toe direction, located within a chamber formed in a bottom portion of the golf club head when at address;

a first weight member slidably engaged with the iron type golf club head body along the first rail; and a second weight member slidably engaged with the iron type golf club head body along the second rail;

wherein the second weight member slidably engages with the iron type golf club body along the second rail by slidably engaging from a toe side end of the second rail horizontally parallel to the sole surface toward a heel side end of the second rail, wherein the second weight member forms a portion of the sole surface of the iron type golf club head body;

wherein the first and second weight members have different weighting characteristics from one another but are substantially the same size, shape, and structure;

wherein interchanging the arrangement of the first and second weights with the first rail and the second rail adjust the center of gravity vertically when the golf club head is at address; and wherein adjusting the center of gravity vertically can affect the trajectory and ball flight of a golf ball struck by the golf club head.

9. A golf club head according to claim 8, wherein when the golf club head is at address, the first and second weight members include a groove on a front surface;

wherein the groove has a rear portion and a front portion, wherein the rear portion is larger than the front portion.

10. A golf club head according to claim 9, wherein the first and second rails have a rear portion and a front portion, and wherein the rear portion is larger than the front portion; and the rear portion of the rail engages the rear portion of the groove on the first and second weight members.

11. A golf club head according to claim 10, wherein the first and second rails have at least one angled side wall.

12. A golf club head according to claim 8, wherein the first and second weight members are secured using an end cap, wherein the end cap has a surface shaped to act as a continuation of the toe side of the iron type golf club head body.

13. A golf club head according to claim 8, wherein the first and second weight members abut a surface of the heel portion of the back side of the iron type golf club head body.

14. A golf club head comprising:

an iron type golf club head body comprising a ball striking face, a top rail, a sole, a heel side, a toe side, a hosel, a sole surface, a perimeter weighting member extending rearward from the ball striking face and a rear surface opposite the ball striking face;

wherein a heel perimeter portion and a toe perimeter portion of the perimeter weight member are integrally formed with the iron type golf club head body, wherein when the golf club head is at address, the rear surface includes a first rail positioned in a heel to toe direction, located along a top perimeter of the golf club head within an open space formed in the top rail of the golf club head, and wherein the open space is a gap between the heel portion, the toe portion, and the rear surface;

wherein a chamber is formed in the sole portion of the perimeter weighting member of the golf club head when at address, a second rail positioned within the chamber formed in a sole portion of the perimeter weighting member in a heel to toe direction independent of the first rail, the first and second rail each having a rear portion and a front portion, wherein the rear portion is larger than the front portion; and wherein the perimeter weighting member includes a heel perimeter portion extending around a heel of the iron type golf club head body;

a first weight member comprising a groove on a front surface having a rear portion and a front portion, and a second weight member comprising a groove on a front surface having a rear portion and a front portion;

wherein the groove of the first weight member is configured to slidably engage the first rail from the toe side such that the first weight member is unable to be removed without sliding along the first rail;

wherein the first weight member slidably engages with the iron type golf club body along the first rail by slidably engaging from a toe side end of the first rail horizontally parallel to the ball striking face toward a heel side end of the first rail, wherein the first weight member comprises the upper portion of the perimeter weighting member when slidably engaged with the iron type golf club head along the first rail, wherein the groove of the second weight member is configured to slidably engage the second rail from the toe side such that the second weight member is unable to be removed without sliding along the second rail;

wherein the second weight member slidably engages with the iron type golf club body along the second rail by slidably engaging from a toe side end of the second rail horizontally parallel to the ball striking face toward a heel side end of the second rail, wherein the second weight member comprises a portion of the sole of the iron type golf club body when slidably engaged with the second rail, wherein the first and second weight members have different weighting characteristics from one another but are substantially the same size, shape, and structure;

wherein interchanging the arrangement of the first and second weights with the first rail and the second rail adjust the center of gravity vertically when the golf club head is at address; and wherein adjusting the center of gravity vertically affects the trajectory and ball flight of a golf ball struck by the golf club head.

15. A golf club head according to claim 14, wherein the first and second weight members are secured to the iron type golf club head body using at least one mechanical fastener.

16. A golf club head according to claim 14, wherein the first and second weight members abut a surface of the heel perimeter portion of the perimeter weighting member.

17. A golf club head according to claim 14, wherein the first and second rail have at least one angled side wall.

18. A golf club head according to claim 14, wherein the first and second weight members include:

a longitudinal length configured to extend along the golf club head in a heel to toe direction when the first and second weight members are engaged with the golf club head;

a first longitudinal end; and a second longitudinal end opposite the first longitudinal end, wherein the first and second weight members have a weight distribution along its longitudinal length such that the first longitudinal end is heavier than the second longitudinal end.

* * * * *